US009845559B2

(12) United States Patent
Koike et al.

(10) Patent No.: US 9,845,559 B2
(45) Date of Patent: Dec. 19, 2017

(54) SEWING MACHINE

(71) Applicant: JANOME SEWING MACHINE CO., LTD., Hachioji-shi, Tokyo (JP)

(72) Inventors: Mikio Koike, Ome (JP); Jun Mafune, Kokubunji (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 3 days.

(21) Appl. No.: 15/008,575

(22) Filed: Jan. 28, 2016

(65) Prior Publication Data

US 2016/0258093 A1 Sep. 8, 2016

(30) Foreign Application Priority Data

Mar. 4, 2015 (JP) ..... 2015-042179

(51) Int. Cl.

| | |
|---|---|
| ***D05B 29/02*** | (2006.01) |
| ***D05B 19/12*** | (2006.01) |
| ***D05B 19/16*** | (2006.01) |
| ***D05C 9/06*** | (2006.01) |
| ***D05B 69/28*** | (2006.01) |

(52) U.S. Cl.

CPC ..... *D05B 29/02* (2013.01); *D05B 19/12* (2013.01); *D05B 19/16* (2013.01); *D05B 69/28* (2013.01); *D05C 9/06* (2013.01)

(58) Field of Classification Search

CPC ..... D05B 19/00; D05B 19/02; D05B 19/04; D05B 19/08; D05B 19/10; D05B 19/12; D05B 29/00; D05B 29/02; D05B 21/00; D05B 31/00; D05B 39/00; D05B 69/28; D05B 19/16; D05C 9/06

See application file for complete search history.

(56) References Cited

U.S. PATENT DOCUMENTS

| | | | | | |
|---|---|---|---|---|---|
| 4,704,978 | A | * | 11/1987 | Nomura | D05B 19/00 112/239 |
| 4,986,201 | A | * | 1/1991 | Hyodo | D05B 27/22 112/456 |
| 5,596,941 | A | * | 1/1997 | Landen | D05B 29/12 112/235 |

FOREIGN PATENT DOCUMENTS

| | | | | |
|---|---|---|---|---|
| CN | 1110591 | C | | 6/2003 |
| CN | 1861882 | B | | 9/2011 |
| JP | 63011192 | A | * | 1/1988 |
| JP | 06190165 | A | * | 7/1994 |
| JP | 2006-20757 | A | | 1/2006 |
| JP | 2010-82147 | A | | 4/2010 |
| JP | 5073360 | B2 | * | 11/2012 |

OTHER PUBLICATIONS

Office Action dated Oct. 27, 2016 issued in corresponding Taiwan Application No. 104137975.

* cited by examiner

*Primary Examiner* — Ismael Izaguirre
(74) *Attorney, Agent, or Firm* — Nath, Goldberg & Meyer; Jerald L. Meyer

(57) ABSTRACT

A sewing machine translates a stitchwork frame with which a cloth is fastened along a direction of a plane where the cloth is fastened based on stitchwork data to form a stitchwork pattern. A presser foot located above the cloth has a height changed by an actuator like a stepping motor in accordance with the advancement of a stitchwork formation. Hence, a predetermined clearance between the cloth and the presser foot is maintained.

4 Claims, 16 Drawing Sheets

| THREAD SIZE : XXX | |
|---|---|
| THREAD REDUNDANT NUMBER | PRESSER FOOT HEIGHT LEVEL |
| 0 | 0 |
| 1 | 0 |
| 2 | 0 |
| 3 | 1 |
| 4 | 1 |
| 5 | 1 |
| 6 | 2 |
| ⋮ | ⋮ |

95a

*FIG. 8*

| THREAD REDUNDANT NUMBER | HEIGHT LEVEL |
|---|---|
| ・・・ | ・・・ |
| 1 | 0 |
| ・・・ | ・・・ |

SEWING MACHINE

CROSS-REFERENCE TO RELATED APPLICATION

This application is based upon and claims the benefit of priority from Japan Patent Application No. 2015-042179, filed on Mar. 4, 2015, the entire contents of which are incorporated herein by reference.

FIELD OF THE INVENTION

The present invention relates to a stitchwork sewing machine.

BACKGROUND

Sewing by a sewing machine is performed while a cloth is held by a presser foot. The presser foot has a primary function of suppressing, when a needle is pulled out from a cloth, an uplifting of the cloth associated with the pulled-out needle. In addition, the presser foot has a secondary function of holding the cloth together with a feed dog, and ensuring a cloth feeding. When, however, a stitchwork formation is performed on the cloth, the cloth is held by a stitchwork frame, and the cloth is translated in vertical and horizontal directions by a frame driving mechanism, and feed dog is not utilized at this time. The presser foot at the time of stitchwork formation is mainly utilized to suppress an uplifting of the cloth associated with the pulled-out needle.

Pushing the cloth so as to contact with the feed dog by the presser foot disturbs an operation of the frame driving mechanism. In addition, frictional damages are likely to be formed on the cloth and a stitchwork pattern. In order to suppress an uplifting of the cloth, it is sufficient if the presser foot is positioned so as to be slightly apart from the surface of the cloth. Hence, according to conventional technologies, when a sewing machine is utilized for a stitchwork formation, the presser foot is lifted up by a predetermined distance from the surface of the cloth before a stitchwork formation starts, and then the stitchwork formation is started (see, for example, JP2006-20757 A).

The presser foot is attached to a presser bar that is capable of moving up and down. Before a stitchwork formation starts, the presser bar is moved down to cause the presser foot to be once in contact with a cloth, and the presser bar is moved up by a predetermined distance from the contact position. Next, the presser foot is fixed at a height where the presser bar completes the move-up operation, and then the stitchwork formation is started.

According to JP2006-20757 A, the height of the presser foot that has been set initially at the beginning of the stitchwork formation is always maintained during the stitchwork formation. Depending on a pattern to be stitched, however, a thread may overlap several times relative to the cloth. A pattern to be formed on the cloth increases the thickness along with the advancement of the stitchwork formation, and the clearance below the presser foot becomes narrower than the predetermined distance that has been set initially.

When the clearance below the presser foot becomes narrow, the presser foot may contact the pattern. In this case, an improper sewing, such as frictional damages to the cloth and the stitchwork pattern, may occur, decreasing a quality. Conversely, when the height of the presser foot is initially set in consideration of the thickness of the pattern to be formed beforehand, the clearance between the surface of the cloth and the presser foot is too wide at the beginning of a stitchwork formation, and thus the presser foot is unable to surely suppress an uplifting of the cloth.

The present invention has been proposed to address the above-explained technical problems of conventional technologies, and it is an objective of the present invention to provide a sewing machine that does not deteriorate qualities of a cloth and a stitchwork pattern even if a thickness of a stitchwork pattern increases along with an advancement of a stitchwork formation.

SUMMARY OF THE INVENTION

In order to accomplish the above objective, a sewing machine according to an aspect of the present invention is to forma stitchwork pattern on a cloth, and the sewing machine includes:

- a stitchwork data memory storing stitchwork data, the stitchwork data being to form the stitchwork pattern;
- a stitchwork frame fastening the cloth;
- a frame driving mechanism translating the stitchwork frame horizontally along a direction of a plane where the cloth is fastened based on the stitchwork data;
- a presser foot located above the cloth; and
- an actuator changing a height of the presser foot in accordance with an advancement of a stitchwork formation, and maintaining a predetermined clearance below the presser foot with the cloth.

The actuator may change the height of the presser foot in accordance with a thickness of the stitchwork pattern, the thickness changing in accordance with the advancement of the stitchwork formation.

The sewing machine may further include a detecting unit detecting the thickness of the stitchwork pattern within a range overlapping with the presser foot in accordance with the advancement of the stitchwork formation.

The detecting unit may calculate the thickness of the stitchwork pattern within the range overlapping with the presser foot based on the stitchwork data.

The detecting unit may:

- include a simulator simulating an arrangement of a thread for each needle locating step based on the stitchwork data, and calculating a thread redundant number at each location for each needle locating step based on the arrangement of the thread; and
- detect, as the thickness of the stitchwork pattern, the thread redundant number within the range overlapping with the presser foot.

The detecting unit may further include a table storing, in association with each other, the height of the presser foot and the thread redundant number, and the actuator may change the height of the presser foot to the height associated with the thread redundant number detected by the detecting unit.

The height of the presser foot may be changed in accordance with the advancement of the stitchwork formation so as to fall into a range between equal to or larger than 1.2 mm and equal to or smaller than 1.5 mm.

According to the present invention, a possibility that the presser foot contacts a cloth is remarkably reduced even if a stitchwork formation advances, and thus a deterioration of the quality of a stitchwork pattern like frictional damages to the cloth by the presser foot can be prevented.

BRIEF DESCRIPTION OF THE DRAWINGS

FIG. 8 is a diagram illustrating a table for a height of the presser foot;

FIG. 9A illustrates a first condition in which the presser foot is in contact with a cloth, while FIG. 9B illustrates a second condition in which the presser foot is lifted up from the first condition;

DETAILED DESCRIPTION OF THE EMBODIMENTS

Entire Structure of Sewing Machine

Figure 1:
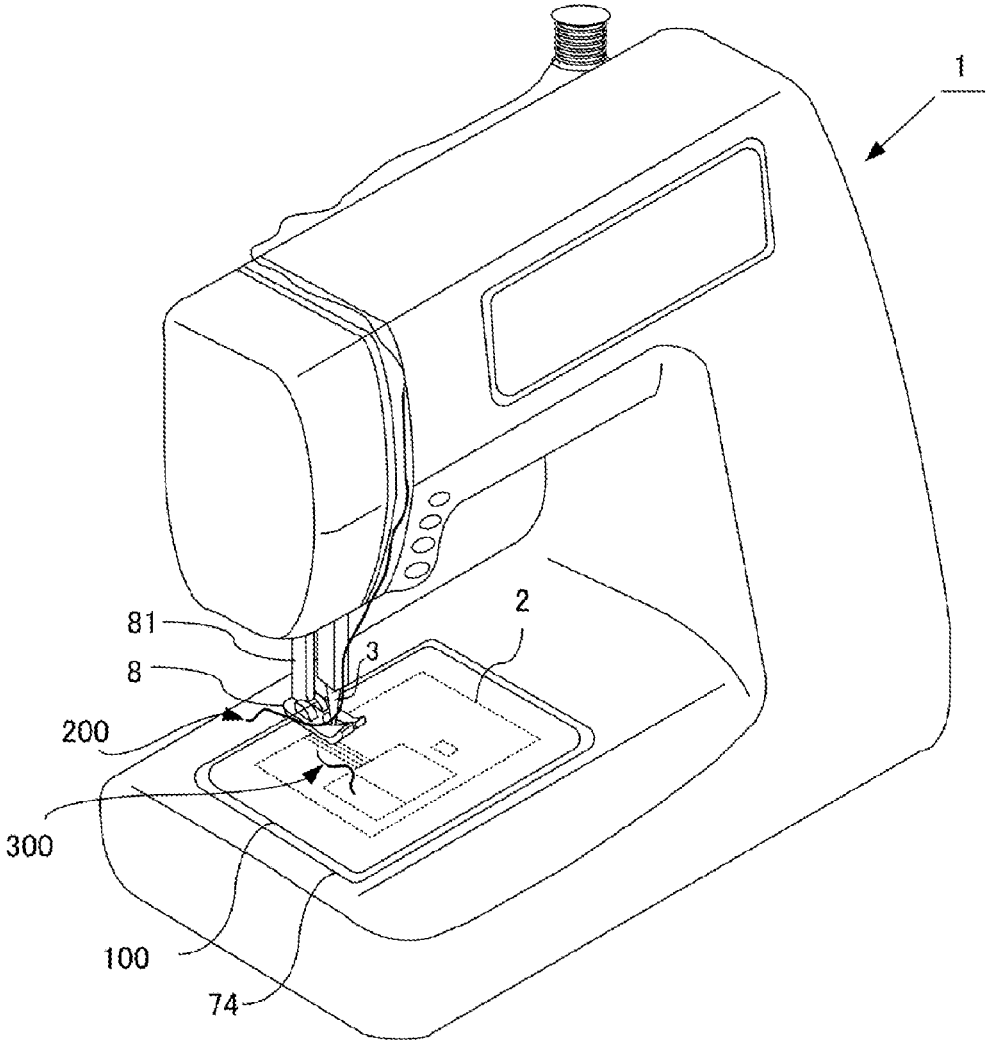
FIG. 1 is a diagram illustrating an entire structure of an external appearance of a sewing machine.
Figure 2:
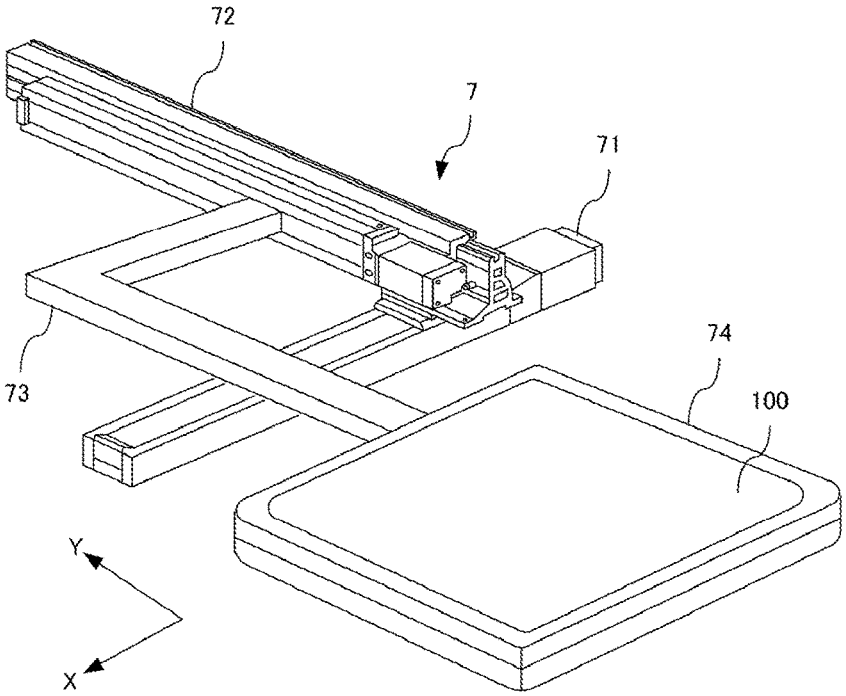
FIG. 2 is a diagram illustrating an entire structure of a frame driving mechanism.

As illustrated in FIG. 1, a sewing machine 1 is a home, professional or industrial machine that performs a stitchwork formation on a cloth, locates a needle 3 on a cloth placed on a needle plate 2, and intertwines a needle thread 200 with a bobbin thread 300, thereby forming a seam and a processed cloth 100. The processed cloth 100 is a cloth formed with stitchwork patterns. During a stitchwork formation, the sewing machine 1 positions a presser foot 8 above the processed cloth 100. As illustrated in FIG. 2, this sewing machine 1 translates the processed cloth 100 horizontally by a frame driving mechanism 7, thereby performing a stitchwork formation on the processed cloth 100 while changing the relative needle location to the processed cloth 100.

The frame driving mechanism 7 is attachable to the sewing machine 1, or is built in the sewing machine 1. The frame driving mechanism 7 includes an X-linear slider 71 that moves a stitchwork frame 74 in an X-axis direction, and a Y-linear slider 72 that moves the stitchwork frame 74 in a Y-axis direction. The X-axis direction corresponds to the lengthwise direction of the sewing machine 1, while the Y-axis direction corresponds to the widthwise direction of the sewing machine 1.

The X-linear slider 71 has the Y-linear slider 72 slidably provided on a rail that extends in the X-axis direction, and has the Y-linear slider 72 orthogonally fastened with an endless belt that runs in the X-axis direction. The endless belt is run by an X-axis motor, and thus the Y-linear slider 72 is moved along the X-axis direction. The Y-linear slider 72 has a stitchwork-frame arm 73 slidably provided on a rail that extends in the Y-axis direction, and has the stitchwork-frame arm 73 fastened with an endless belt that runs in the Y-axis direction. The endless belt is run by a Y-axis motor, and thus the stitchwork-frame arm 73 is moved along the Y-axis direction.

The stitchwork-frame arm 73 is a support for a stitchwork frame 74, has a leading end to which the stitchwork frame 74 is attached, and has the Y-linear slider 72 serving as basal end. The stitchwork frame 74 includes an internal frame and an external frame, and the external frame is overlaid on the internal frame on which the processed cloth 100 is mounted, thereby holding the processed cloth 100 between the internal frame and the external frame, and also fastening the processed cloth 100. The processed cloth 100 is positioned on a needle plate 2 so as to be translated horizontally by the frame driving mechanism 7 along the direction of a plane on which the processed cloth 100 is fastened.

Figure 3:
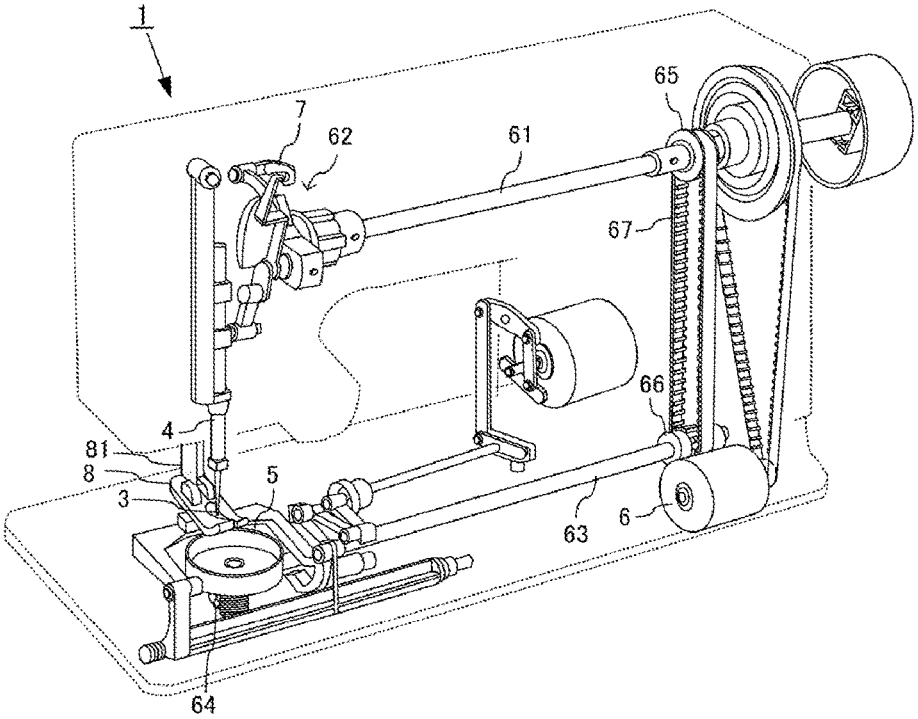
FIG. 3 is a diagram illustrating an internal structure of the sewing machine.

As illustrated in FIG. 3, the sewing machine 1 includes a needle bar 4 and a hook 5. The needle bar 4 extends vertically relative to the needle plate 2, and is attached so as to be movable up and down along the vertical direction. This needle bar 4 has a leading end which is positioned at the needle-plate-2 side, and which supports the needle 3 that holds the needle thread 200. The hook 5 is formed in a hollow drum shape with an opened plane, and is attached horizontally or vertically relative to the needle plate 2, and is rotatable in a circumferential direction. In this embodiment, the hook 5 is horizontally attached, and holds therein a bobbin around which the bobbin thread 300 is wound.

According to this sewing machine 1, by the up-and-down movement of the needle bar 4, the needle 3 together with the needle thread 200 passes through the processed cloth 100, and a needle thread loop due to a friction between the processed cloth 100 and the needle thread 200 is formed when the needle 3 moves up. Next, the rotating hook 5 catches the needle thread loop, and the bobbin that is supplying the bobbin thread 300 passes through the needle thread loop along with the rotation of the hook 5. Hence, the needle thread 200 and the bobbin thread 300 are intertwined with each other, and thus a seam is formed.

The needle bar 4 and the hook 5 are driven through various transmission mechanisms with a sewing-machine motor 6 being as a common drive source. The needle bar 4 is linked with, via a crank mechanism 62, an upper shaft 61 that extends horizontally. The rotation of the upper shaft 61 is converted into a linear motion by the crank mechanism 62, and is transmitted to the needle bar 4. Hence, the needle bar 4 moves up and down. The hook 5 is linked with, via a gear mechanism 64, a lower shaft 63 that extends horizontally. When the hook 5 is attached horizontally, the gear mechanism 64 is, for example, a cylindrical worm gear that converts an axial angle to 90 degrees. The rotation of the lower shaft 63 is converted by 90 degrees by the gear mechanism 64 and is transmitted to the hook 5, and thus the hook 5 horizontally rotates.

The upper shaft 61 is provided with a pulley 65 that has a predetermined number of teeth. In addition, the lower shaft 63 is provided with a pulley 66 that has the same number of teeth as that of the pulley 65 of the upper shaft 61. Both pulleys 65, 66 are linked with each other by a toothed belt 67. When the upper shaft 61 rotates together with the rotation of the sewing-machine motor 6, the lower shaft 63 rotates via the pulleys 65, 66 and the toothed belt 67. Hence, the needle bar 4 and the hook 5 are actuated in synchronization with each other.

The presser foot 8 is attached to the leading end of a presser bar 81, and faces the needle plate 2 via the processed cloth 100 stretched on the stitchwork frame 74. The presser bar 81 is attached to a sewing-machine frame, extends vertically toward the needle plate 2, and is movable up and down along the direction of the axis of the needle bar 4. The presser bar 81 that moves up and down causes the presser foot 8 to move close to or move apart from the processed cloth 100.

Detail of Presser Foot

Figure 4:
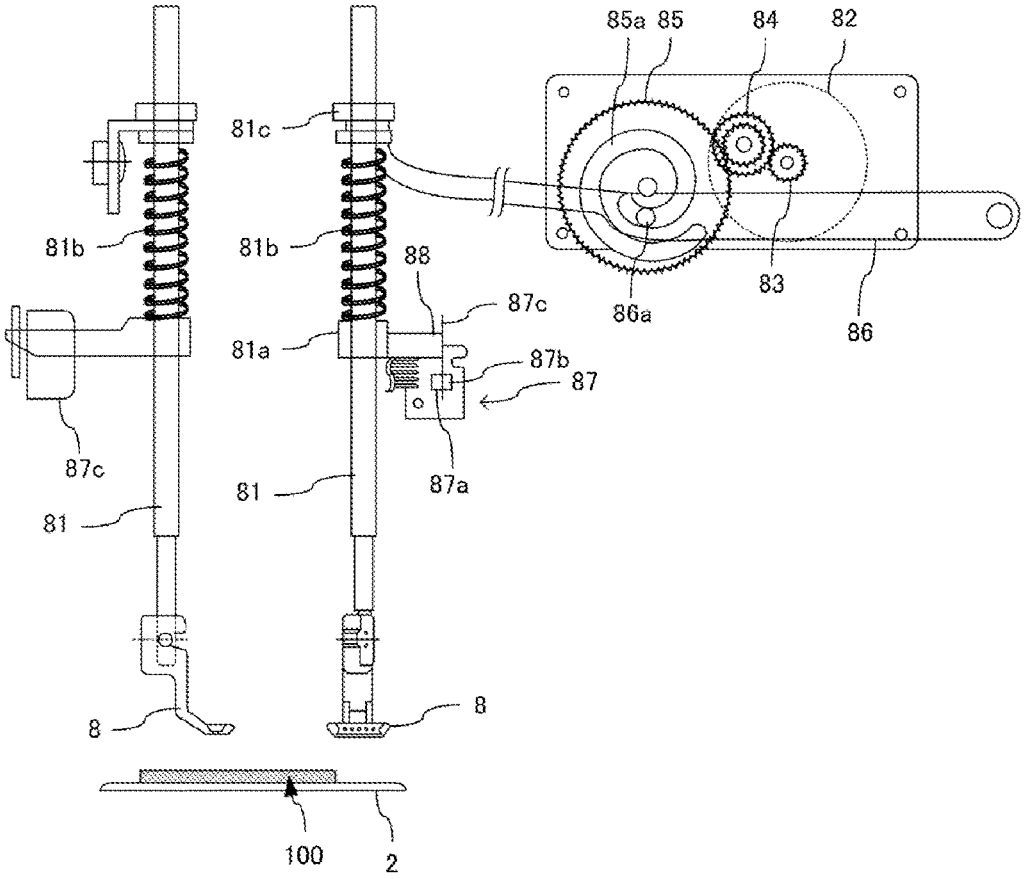
FIG. 4 is a diagram illustrating a detailed structure of a presser foot.

As illustrated in FIG. 4, the presser bar 81 utilizes, as an actuator, a stepping motor 82 built in the sewing machine 1 to move up and down. The stepping motor 82 includes a rotation shaft that has a drive gear 83. The drive gear 83 is meshed with a double-gear set 84. The double-gear set 84 includes a larger-diameter gear and a smaller-diameter gear integrated with each other on the same axis, and serves as an intermediate gear for deceleration. The larger-diameter gear is meshed with the drive gear 83. The smaller-diameter gear is meshed with a cam disk 85 that has gear teeth arranged side by side along the outer circumference. The cam disk 85 has a parallel surface with the axis of the presser bar 81, and a spiral cam groove 85*a* that spreads out in a radial direction is formed in such a surface. The cam groove 85*a* has a spiral center that is the rotation center of the cam disk 85. The cam groove 85*a* is engaged with a follower protrusion 86*a*.

The follower protrusion 86*a* is provided on a presser-bar lifting lever 86 so as to protrude therefrom. The follower protrusion 86*a* is restricted so as to be slidable in parallel with the direction in which the presser bar 81 is slidable. The presser-bar lifting lever 86 has one end freely rotatably supported, and extends toward the presser bar 81 so as to be orthogonal to the presser bar 81 with a rotatably supported end being as a basal end. The presser-bar lifting lever 86 also has a leading end linked with the presser bar 81.

When the stepping motor 82 is actuated, the cam disk 85 rotates via the drive gear 83 and the double-gear set 84. In accordance with the rotation direction of the cam disk 85, the cam groove 85*a* traced by the follower protrusion 86*a* spreads out in the radial direction of the cam disk 85, or decreases in the radial direction of the cam disk 85. When the cam groove 85*a* spreads out in the radial direction, the follower protrusion 86*a* moves down toward the needle plate 2, and when the cam groove 85*a* traced by the follower protrusion 86*a* decreases in the radial direction, the follower protrusion 86*a* moves up so as to be apart from the needle plate 2.

When the follower protrusion 86*a* moves down, the presser-bar lifting lever 86 swings around the basal end, and pushes down the linked point with the presser bar 81, and thus the presser bar 81 moves down. When the follower protrusion 86*a* moves up, the presser-bar lifting lever 86 swings around the basal end, and pushes up the linked point with the presser bar 81, and thus the presser bar 81 moves up.

The presser bar 81 includes a flange 81*a* provided at a halfway location and spreading in the radial direction of the presser bar 81, and a compression spring 81*b* is fitted over the presser bar 81 with this flange 81*a* being as a spring seat. The leading end of the presser-bar lifting lever 86 is formed in a ring shape, and the presser bar 81 is fitted in this ring portion, and thus this ring portion depresses the compression spring 81*b*. The compression spring 81*b* has a spring constant that is set so as not to be compressed by the push-down force from the presser-bar lifting lever 86 when the presser foot 8 is in a floating condition. Hence, the presser bar 81 is pushed through the flange 81*a* via the compression spring 81*b*, and is moved down by the presser-bar lifting lever 86.

In addition, the presser bar 81 includes a flange 81*c* provided at the location right above the leading end of the presser-bar lifting lever 86, and spreading in the radial direction of the presser bar 81. When the presser-bar lifting lever 86 is swung up, such a leading end pushes up the flange 81*c*, and thus the presser bar 81 moves up.

The move-up or move-down amount of the presser bar 81 is detected by an encoder 87. The encoder 87 includes a photo interrupter and an elongated linear scale 87*c*. The photo interrupter includes a light emitting diode 87*a* and a photo transistor 87*b*. Those elements are fixed at respective stationary locations so as to face with each other. The elongated linear scale 87*c* includes slits which are arranged side by side in the lengthwise direction, and which are present between the light emitting diode 87*a* and the photo transistor 87*b*. The elongated linear scale 87*c* is fastened to a presser bar holder 88 that is fastened to the presser bar 81, and extends in parallel with the direction in which the presser bar 81 moves up and down.

When the presser bar 81 moves up and down, by the presser bar holder 88, the elongated linear scale 87*c* moves up and down in conjunction with the presser bar 81. The encoder 87 counts the number of slits of the elongated linear scale 87*c* which pass through between the light emitting diode 87*a* and the photo transistor 87*b*, and thus the move-up or move-down amount of the presser bar 81 is detected.

Controller

Figure 5:
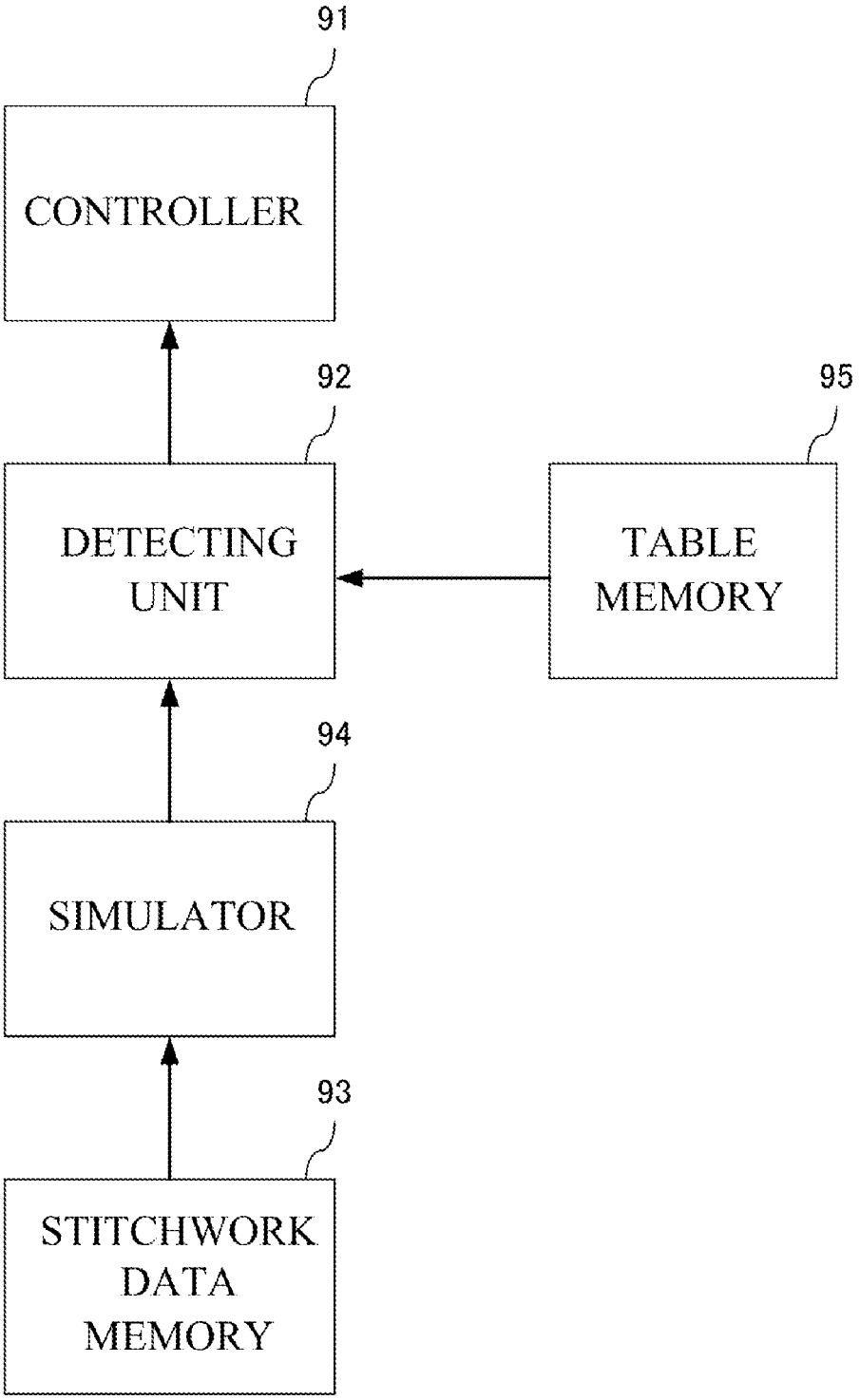
FIG. 5 is a diagram illustrating a structure of a controller that controls the presser foot to move up and down.

FIG. 5 is a block diagram illustrating a structure of a controller 91 that controls the move-up and move-down operations of the presser foot 8. The controller 91 is a so-called computer built in the sewing machine 1. That is, the controller 91 includes a CPU, memories, motor drivers, and operation hardware. One of the motor drivers is for the stepping motor 82 that is the drive source for the presser bar 81. The operation hardware is an interface that accepts an input given by a user, and is, for example, a touch panel.

This controller 91 changes the height of the presser foot 8 in accordance with the advancement of a stitchwork formation so as to have a predetermined clearance between the bottom end of the presser foot 8 and the surface of the processed cloth 100. When a stitchwork pattern being formed on the processed cloth 100 increases the thickness, the height of the presser foot 8 is changed in accordance with this increasing thickness.

The clearance has a dimension which enables the presser foot 8 to suppress an uplifting of the processed cloth 100 to be caused by the needle 3 pulled out from the processed cloth 100, and which does not disturb a feeding of the processed cloth 100. For example, the clearance is set to be between equal to or larger than 1.2 mm and equal to or smaller than 1.5 mm. The surface of the processed cloth 100 means, in the case of an exposed portion of the cloth not formed with a stitchwork pattern yet, a direct surface of the cloth, and in the case of a portion where the stitchwork pattern has been already formed by a stitchwork formation, a surface with an increasing thickness by the stitchwork pattern.

In order to change the height of the presser foot 8, the controller 91 includes a detecting unit 92 that detects the thickness of a stitchwork pattern within a range where the presser bar 8 overlaps. The controller 91 moves up and down the presser foot 8 in accordance with a detection result by the detecting unit 92. This detecting unit 92 refers to stitchwork data 93*a* to detect the thickness of a stitchwork pattern. In order to do so, the detecting unit 92 includes a stitchwork data memory 93, a simulator 94, and a table memory 95.

Figure 6:
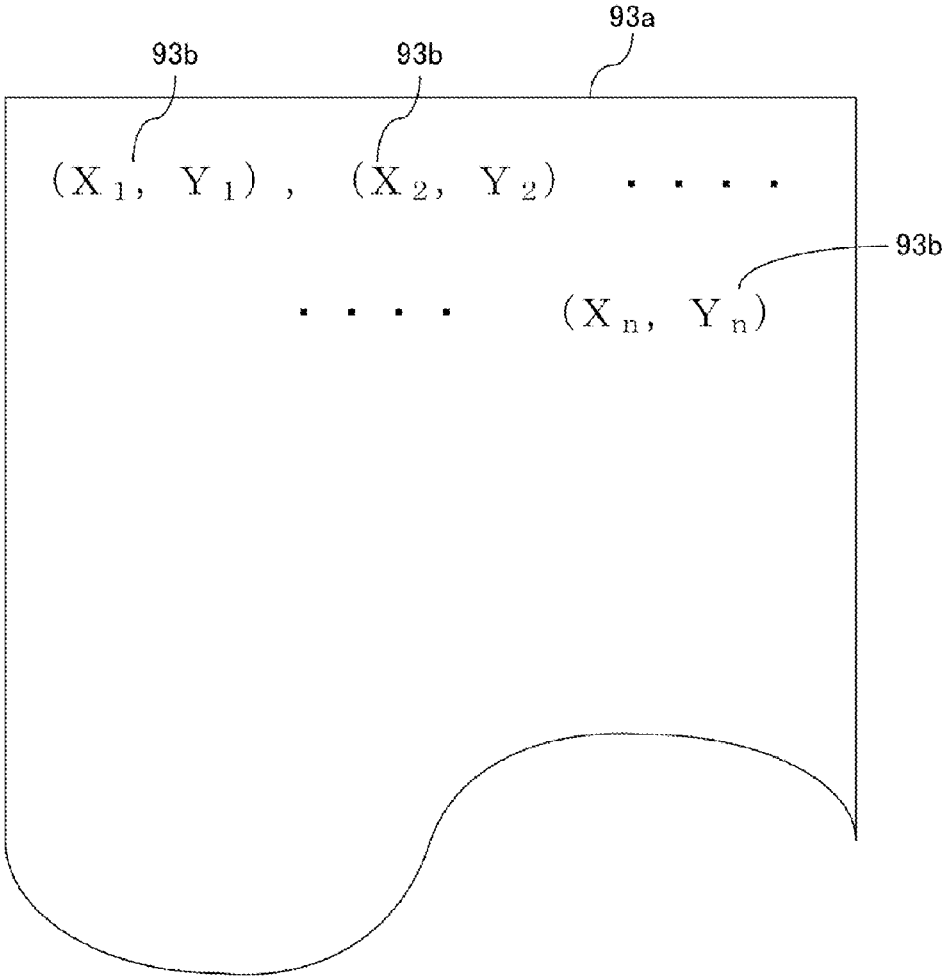
FIG. 6 is a diagram illustrating a data structure of stitchwork data.

The stitchwork data memory 93 mainly includes a memory device. The stitchwork data memory 93 stores the stitchwork data 93*a*. The stitchwork data 93*a* defines a stitchwork pattern, and as illustrated in FIG. 6, includes a needle location coordinate 93*b* of each seam and operation commands like thread cutting. The needle location coordinate 93*b* indicates XY coordinates in the Cartesian coordinate system unique to the sewing machine 1.

The controller 91 reads the stitchwork data 93*a* from the header of data string. Next, the controller 91 calculates an amount of movement to align the needle 2 with the needle location coordinate 93*b*, and outputs, to the frame driving mechanism 7, an instruction signal that contains information on the calculated amount of movement. The frame driving mechanism 7 moves the stitchwork frame 74 in accordance with the instruction signal, and actuates the sewing-machine motor 6 by a predetermined rotation amount in accordance with an instruction signal from the controller 91, thereby forming a seam by a stitch. This single cycle will be referred to a needle locating step. When the stitchwork data 93*a* read for the next step is the needle location coordinate 93*b*, like the last step, after the stitchwork frame 74 is moved, a seam is formed by a stitch, and when the read stitchwork data 93*a* is an operation command like thread cutting, the controller 91 causes the sewing machine 1 to operate in accordance with the given command.

Figure 7:
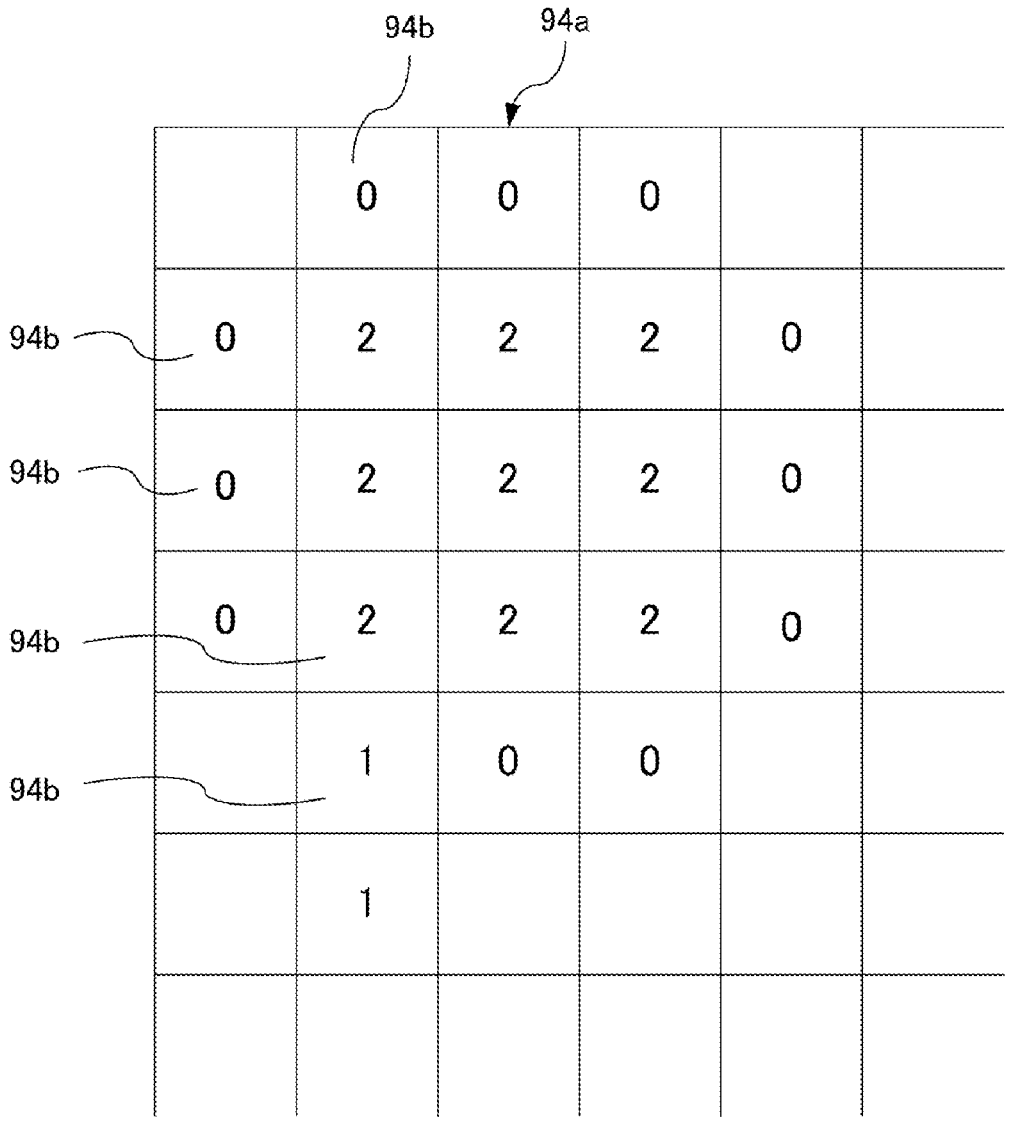
FIG. 7 is a diagram illustrating a map created by a simulator.

The simulator 94 mainly includes a CPU. This simulator 94 refers to the stitchwork data 93*a* to create a map 94*a* that reflects the status of a stitchwork formation, and updates this map for each needle locating step. FIG. 7 is an exemplary diagram illustrating the map 94*a* that is updated by the simulator 94. As illustrated in FIG. 7, the map 94*a* has a thread redundant number 94*b* associated with each coordinate of the Cartesian coordinate system unique to the sewing machine 1. The thread redundant number 94*b* is numerical information, and may be reworded as a number of thread passes up to the step having undergone updating.

When updating the map 94*a* to the map in the (X)th step, the simulator 94 simulates the thread arrangement through each step from the first step to the (X)th step, and counts the number of thread passes for each coordinate. For example, the simulator 94 calculates a line segment that interconnects the needle location coordinate 93*b* in the (X−1)th step with the needle location coordinate 93*b* in the (X)th step, and increments, by 1, the thread redundant number 94*b* at each coordinate where the calculated line segment passes. The thread redundant number 94*b* has an initial number that is zero.

The table memory 95 mainly includes a memory device. This table memory 95 stores a table 95*a*. As illustrated in FIG. 8, the table 95*a* is a list of the heights of the presser foot 8 for each thread redundant number 94*b*. This table 95*a* is created for each thickness of the thread. For example, the table 95*a* is stored for each thread size. The height of the presser foot 8 is indicated as a height level from the initial height. The initial height is a height obtained by adding a clearance to be created from the surface of the processed cloth 100 when a stitchwork formation starts.

The detecting unit 92 mainly includes a CPU. The detecting unit 92 refers to the map 94*a* in each needle locating step, and detects the thickness of a stitchwork pattern within the overlap range of the presser foot 8. In addition, the detecting unit 92 refers to the table 95*a*, and determines the height level of the presser foot 8 in accordance with the thickness of a stitchwork pattern. The table 95*a* to be referred corresponds to the thickness of the thread that is input through the operation hardware.

More specifically, when updating the map 94*a*, the detecting unit 92 refers to the thread redundant number 94*b* at each coordinate where the thread redundant number 94*b* is changed due to the update, and the thread redundant numbers 94*b* around that coordinate. In other words, the detecting unit 92 refers to the line segment calculated by the simulator 94 and the thread redundant numbers 94*b* around that line segment. The coordinate to be referred and the coordinates around that coordinate are within the overlapping range of the presser foot 8 in the next needle locating step.

The detecting unit 92 searches the maximum value in the referred thread redundant numbers 94*b*, and searches, from the table 95*a*, the height level associated with the maximum value. Next, the controller 91 changes the height of the presser foot 8 in accordance with the height level determined by the detecting unit 92.

The controller 91 stores, in association with each other beforehand, the height level and the number of counts counted by the encoder 87. The controller 91 keeps outputting the actuation signal to the stepping motor 82 until the number of counts that is input by the encoder 87 matches the associated height level, and thus the presser foot 8 is moved up and down.

Example Operation

Figures 9A, 9B:
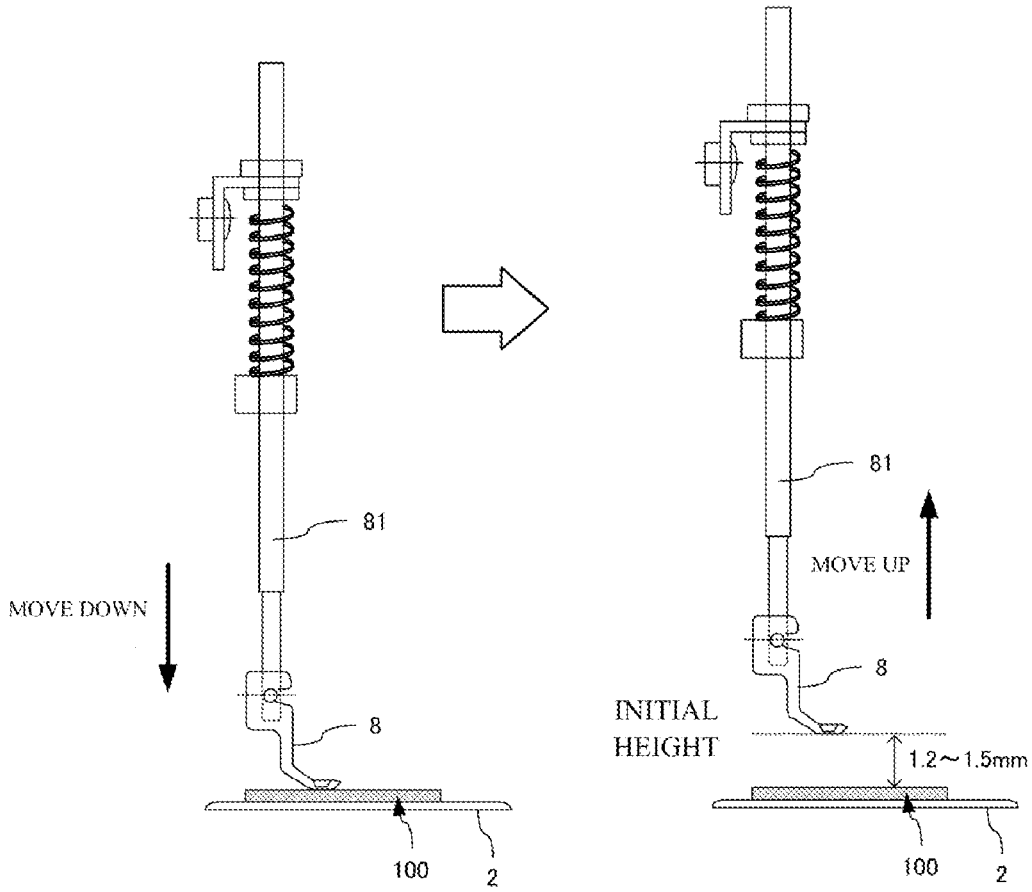
FIGS. 9A and 9B are each a diagram illustrating an initial setting of the presser foot.

An explanation will be given of an example operation of the move-up and move-down control for the presser foot 8 by the controller 91. First, as illustrated in FIG. 9A, the controller 91 actuates the stepping motor 82 at the beginning of a stitchwork formation, and causes the presser foot 8 to be in contact with the processed cloth 100. Next, as illustrated in FIG. 9B, the controller 91 monitors the count value by the encoder 87, and moves up the presser foot 8 to the initial height that falls within a range between equal to or greater than 1.2 mm and equal to or smaller than 1.5 mm.

Subsequently, the sewing machine 1 locates the needle 3 at the needle location coordinate in each step lined up in sequence in the stitchwork data 93*a*. In each step, the simulator 94 creates the map 94*a* for the next step beforehand.

Figure 10A:
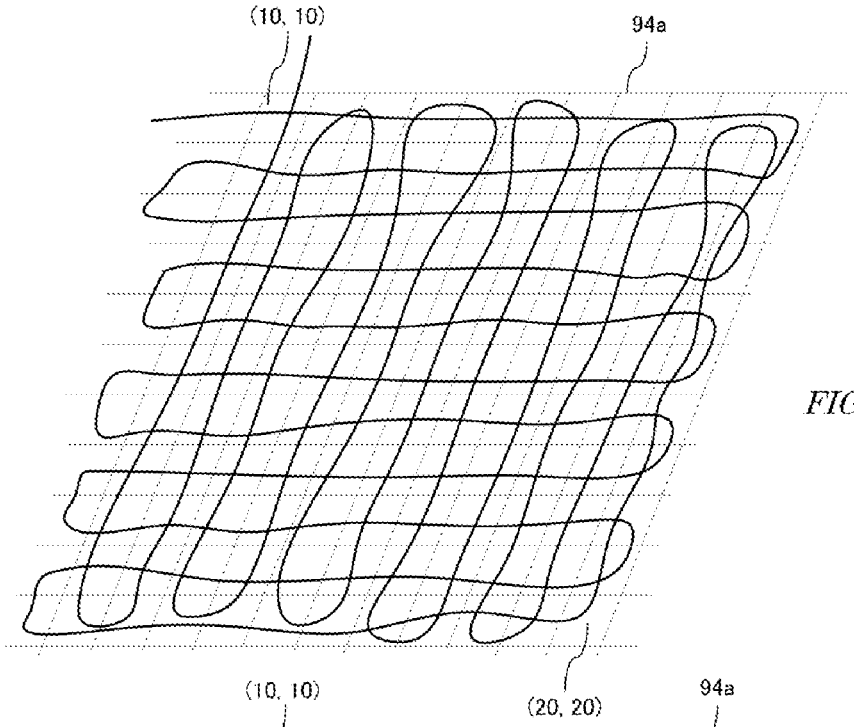
FIG. 10A illustrates an arrangement of a thread up to an (X−1)th step.
Figure 10B:
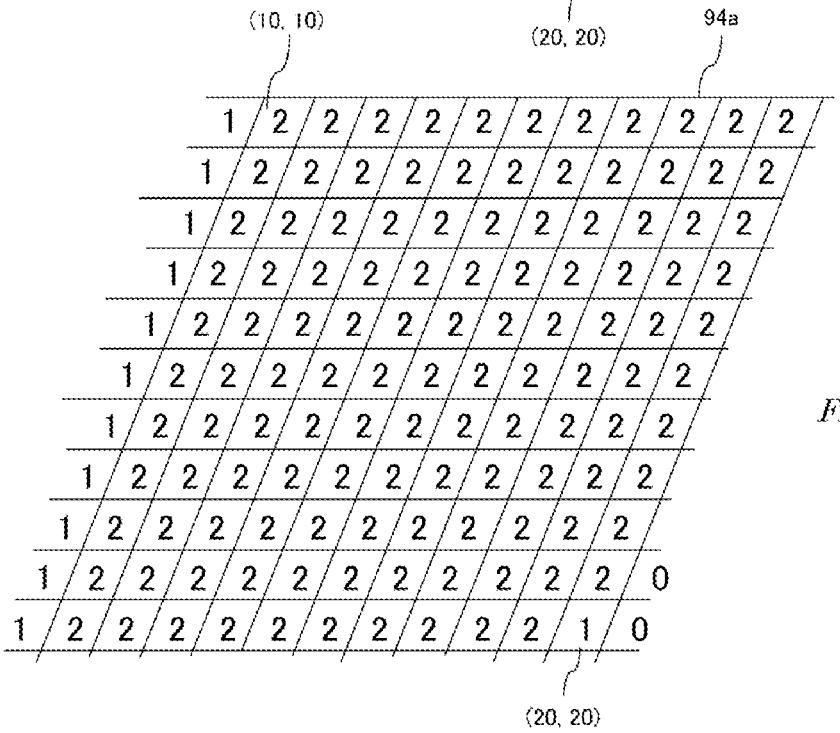
FIG. 10B illustrates a map representing up to the (X−1)th step.

As illustrated in FIG. 10A, it is assumed that, up to the (X−1)th step, the thread reciprocates twice all over within an internal rectangular area defined by the coordinates (10, 10) and the coordinates (20, 20). As illustrated in FIG. 10B, in the map 94*a* that reflects the advancement up to the (X−1)th step, each coordinate within the internal rectangular area defined by the coordinates (10, 10) and the coordinates (20, 20) has the thread redundant number 94*b* that is substantially 2.

Figure 11A:
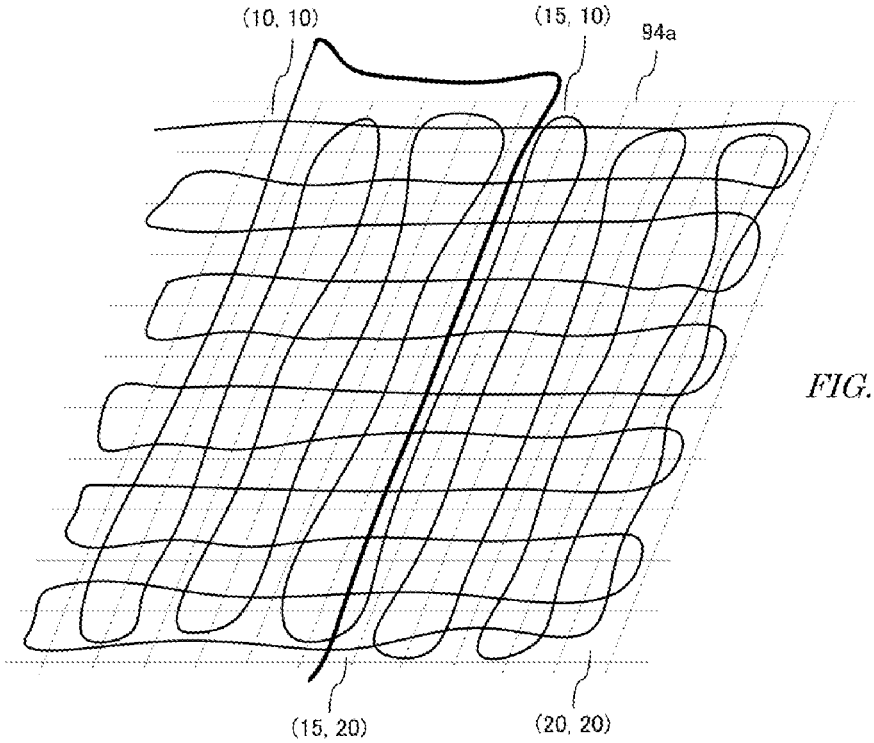
FIG. 11A illustrates an arrangement of a thread up to an (X)th step.
Figure 11B:
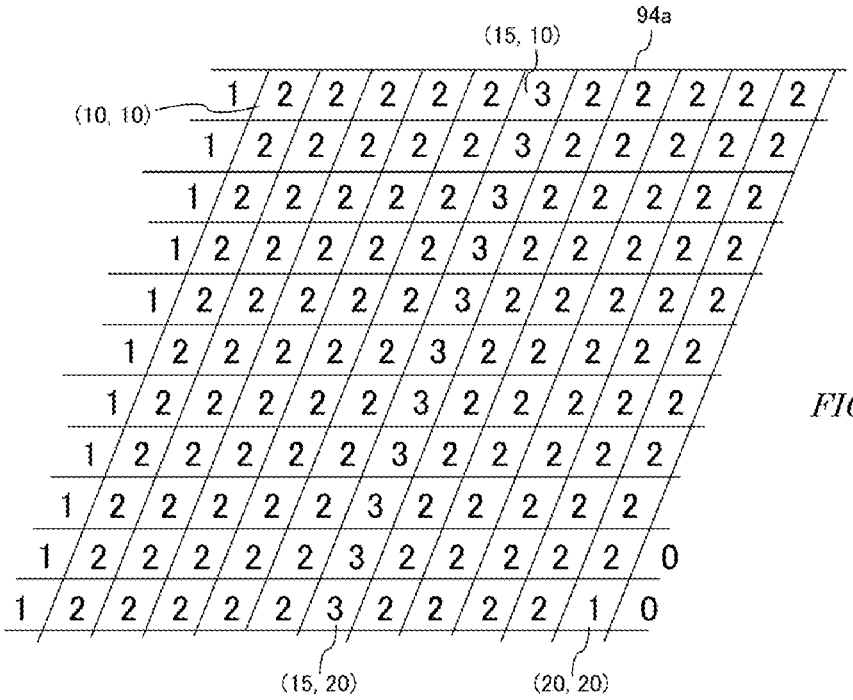
FIG. 11B illustrates a map representing up to the (X)th step.

In the stitchwork data 93*a*, it is assumed that the needle location coordinates in the (X−1)th step are (15, 10), and the needle location coordinates in the (X)th step are (15, 20). In order to create the next map 94*a* that reflects the advancement up to the (X)th step, as illustrated in FIG. 11A, the simulator 94 draws a new line segment that interconnects the coordinates (15, 10) with the coordinates (15, 20). Next, since the thread redundant number 94*b* at each coordinate on this line segment was 2 before the line is drawn, as illustrated in FIG. 11B, the simulator 94 increments the thread redundant number 94*b* associated with each coordinate on the line segment to be 3.

Figure 12:
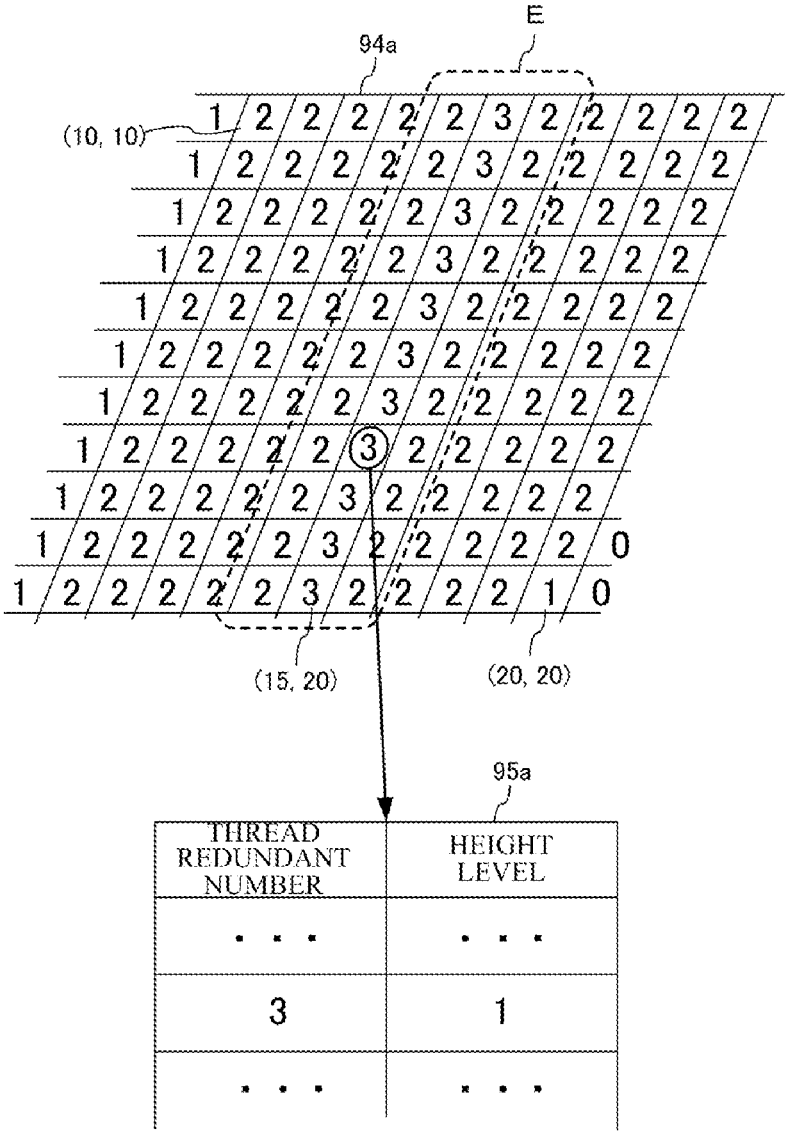
FIG. 12 is an exemplary diagram illustrating a calculation of a thickness of a stitchwork pattern in the (X)th step.

When updating of the map 94*a* up to the (X)th step completes, as illustrated in FIG. 12, the detecting unit 92 searches the maximum value in the thread redundant number 94*b* at each coordinate on the line segment and the thread redundant numbers 94*b* at coordinates within a range E around that coordinate. Since the maximum value is 3, the detecting unit 92 extracts, from the table 95*a*, a height level 1 corresponding to the thread redundant number 94*b* that is 3. The range E is set so as to have a dimension equivalent to a dimension obtained by adding the trajectory of the relative motion between the presser foot 8 and the stitchwork frame 74 to the dimension of the presser foot 8.

Figures 13A, 13B:
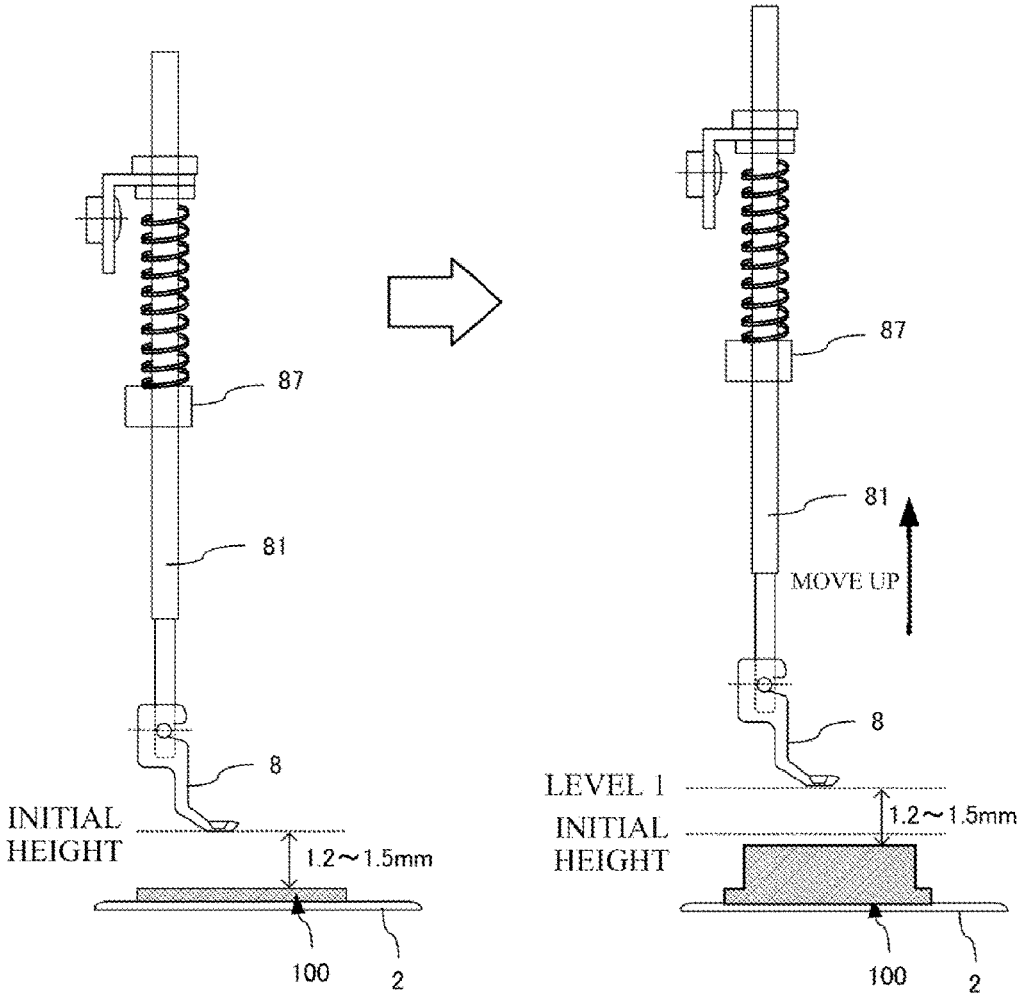
FIGS. 13A and 13B are each a diagram illustrating a move-up operation of the presser foot at the (X)th step.

When the detecting unit 92 determines the height level that is 1, as illustrated in FIG. 13, the controller 91 further moves up the presser foot 8 from the initial height by the amount corresponding to the height level 1. Simultaneously, the controller 91 outputs, to the frame driving mechanism 7, an instruction signal in such away that the needle 3 is located at the needle location coordinates (15, 20) in the (X)th step.

Figure 14A:
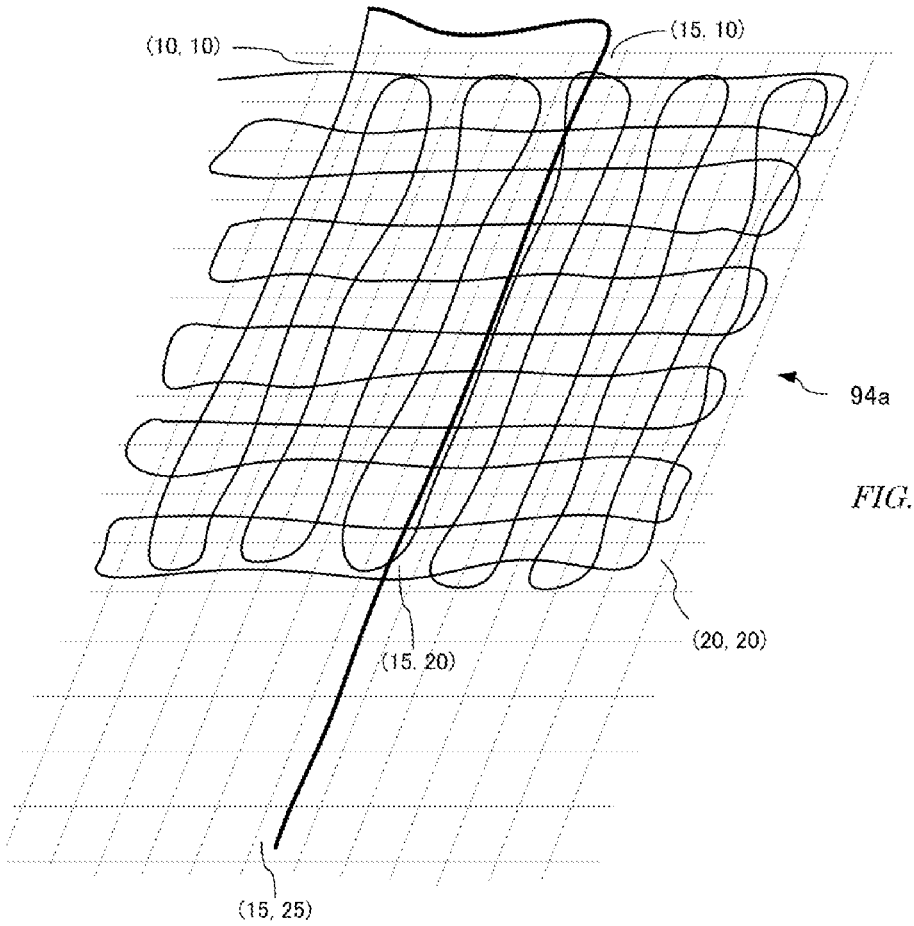
FIG. 14A illustrates an arrangement of a thread up to an (X+1)th step.
Figure 14B:
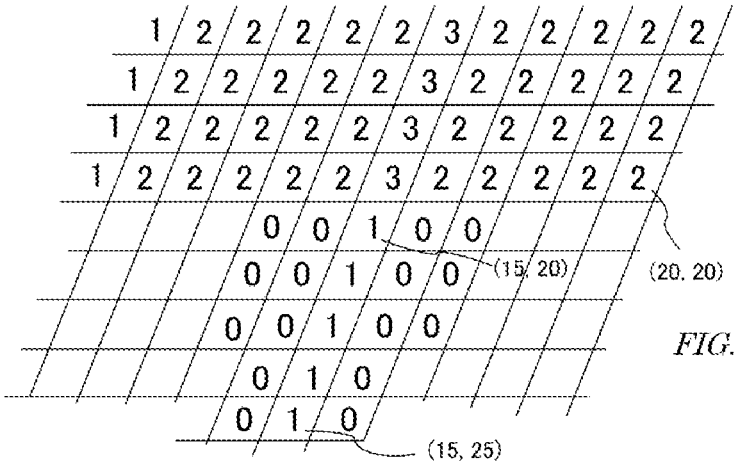
FIG. 14B illustrates a map representing up to the (X+1)th step.

In addition, during the execution of the (X)th needle locating step, the simulator 94 creates the map 94*a* that reflects the advancement up to the (X+1)th step. When the needle locating point in the (X+1)th step is (15, 25), as illustrated in FIG. 14A, the simulator 94 draws a line segment that interconnects the coordinates (15, 20) with the coordinates (15, 25). Next, since the thread redundant number 94*b* at each coordinate on this line segment was zero before the line segment is drawn, as illustrated in FIG. 14B, the simulator 94 increments the thread redundant number 94*b* at each coordinate on the line segment by 1.

Figure 15:
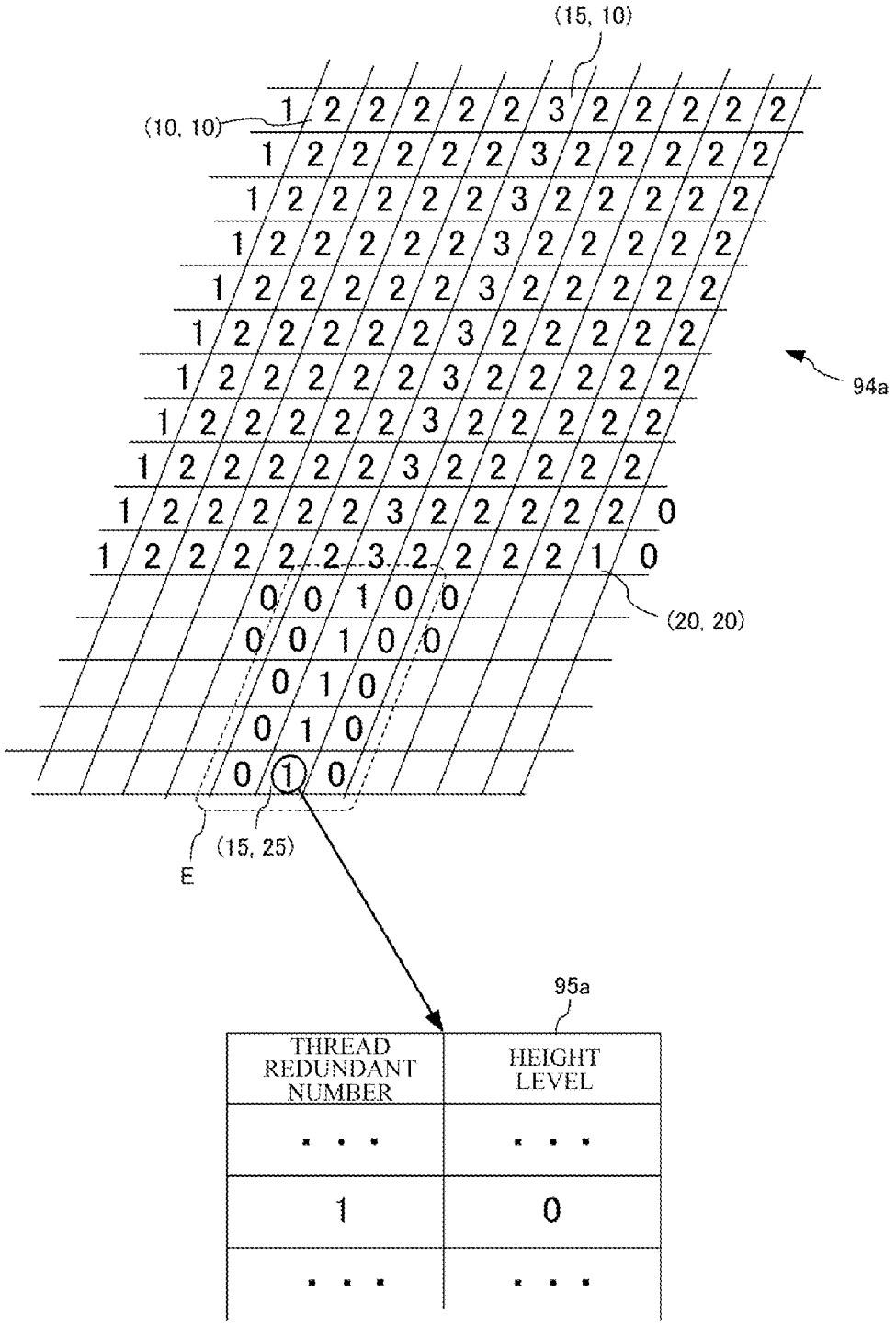
FIG. 15 is an exemplary diagram illustrating a calculation of a thickness of a stitchwork pattern in the (X+1)th step.

By updating the map 94*a*, when the advancement up to the (X+1)th step is reflected, as illustrated in FIG. 15, the detecting unit 92 searches the maximum value in the thread redundant number 94*b* at each coordinate on the line segment that interconnects the coordinates (15, 20) with the coordinates (15, 25), and the thread redundant numbers 94*b* at the coordinates within the range E around that coordinate. Since the maximum value is 1, the detecting unit 92 refers to the table 95*a*, and determines that the height level which is zero corresponds to the thread redundant number 94*b* which is 1.

Figure 16:
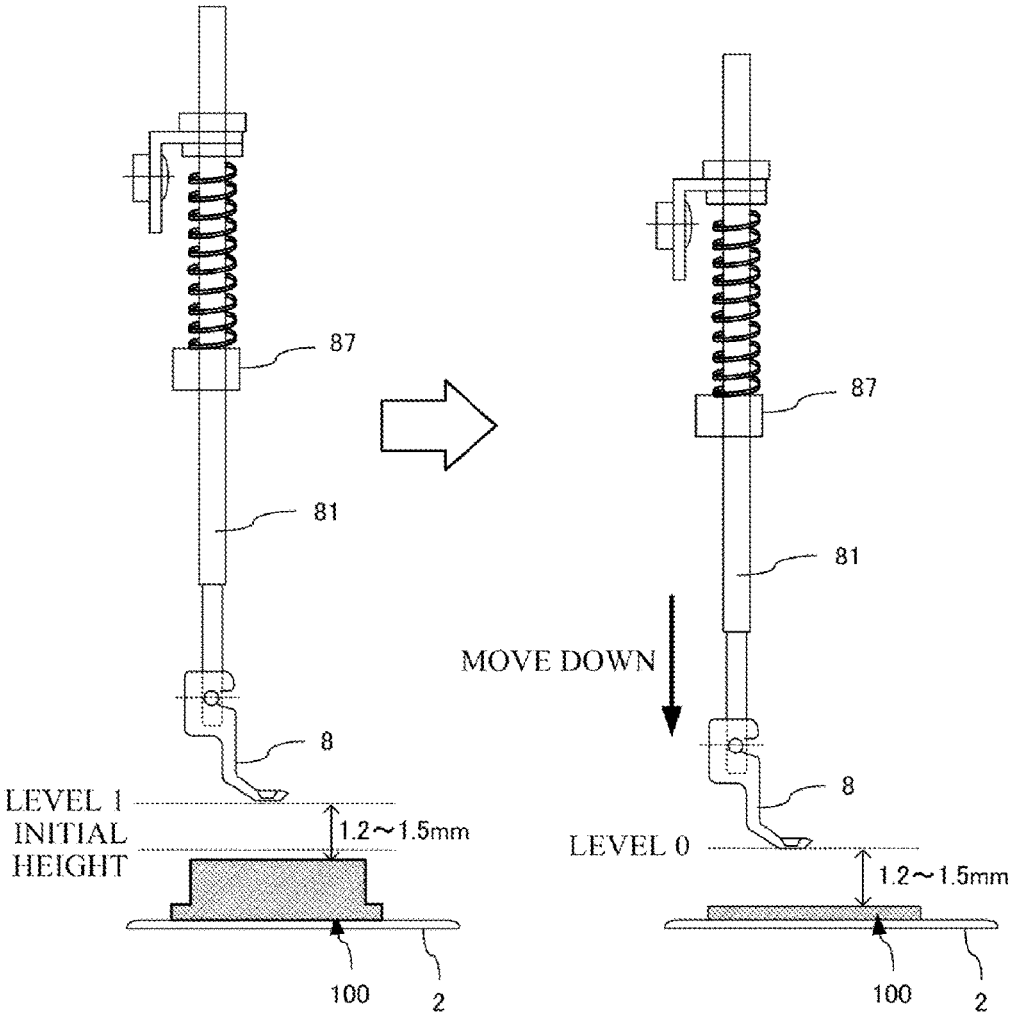
FIGS. 16A and 16B are each a diagram illustrating a move-down operation of the presser foot in the (X+1)th step.

When determination on the height level that is zero by the detecting unit 92 completes, as illustrated in FIG. 16, the controller 91 moves down the presser foot 8 to the initial height in accordance with the height level that is zero. Simultaneously, the controller 91 outputs an instruction signal to the frame driving mechanism 7 in such a way that the needle 3 is located at the needle location coordinates (15, 25) in the (X+1)th step.

Action and Effect

As explained above, the sewing machine 1 performs a stitchwork formation by moving the stitchwork frame 74 that holds the processed cloth 100 along the direction of the plane where the processed cloth 100 is fastened in accordance with the stitchwork data 93*a* to forma stitchwork pattern. In this case, the presser foot 8 located above the processed cloth 100 has the height changed by the actuator like the stepping motor 82 in accordance with the advancement of the stitchwork formation, and the clearance between the processed cloth 100 and the presser foot 8, i.e., the clearance below the presser foot 8 is maintained at the predetermined clearance.

Figure 17:
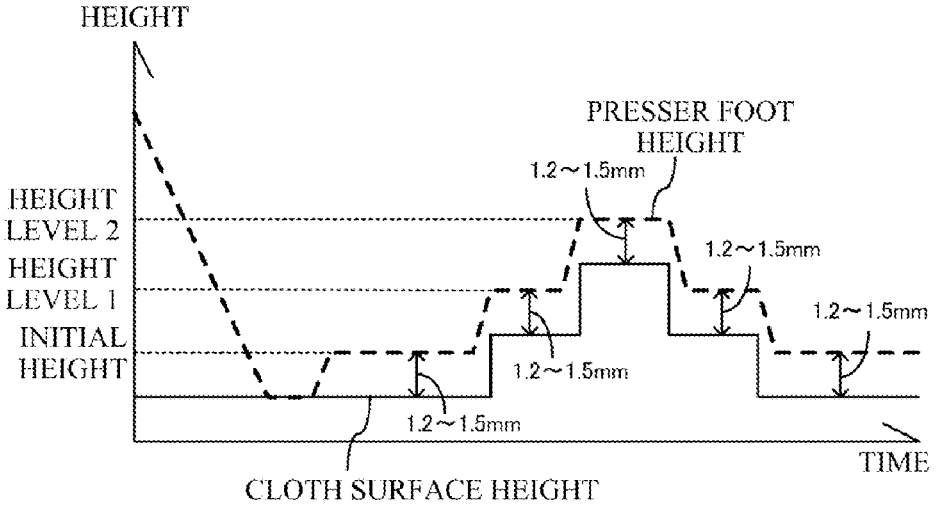
FIG. 17 is a diagram illustrating move-up and move-down operations of the presser foot in accordance with the advancement of a stitchwork formation.

As illustrated in FIG. 17, according to this sewing machine 1, the height of the presser foot 8 changes in accordance with the advancement of a stitchwork formation. Initially, since the thickness of a stitchwork pattern to be formed is zero, after the presser foot 8 becomes in contact with the processed cloth 100, the presser foot 8 is moved up to the initial height to forma clearance with the processed cloth 100 by the predetermined distance. The thickness of the stitchwork pattern increases together with the advancement of the stitchwork formation, and the thickness of the stitchwork pattern that overlaps with the presser foot 8 becomes equal to or greater than a certain thickness. At this time, the presser foot 8 is further moved up from the initial height by the increasing thickness of the stitchwork pattern, thereby avoiding an event in which the clearance becomes insufficient due to the increasing thickness of the stitchwork pattern. In addition, when the presser foot 8 passes through a relatively thin part of the stitchwork pattern, the presser foot 8 is moved down by the decreasing thickness of the stitchwork pattern, thereby avoiding an event in which the clearance becomes excessive due to the decreasing thickness of the stitchwork pattern.

Hence, a possibility that the presser foot 8 contacts the processed cloth 100 and a stitchwork pattern is remarkably reduced although the stitchwork formation advances. Therefore, the occurrence of improper sewing, such as frictional damages to the processed cloth 100 and the stitchwork pattern by the presser foot 8 is prevented, thereby suppressing a deterioration of the quality of a stitchwork pattern.

The presser foot 8 may be moved up and down regardless of the thickness of the stitchwork pattern. For example, portions of the cloth are folded and overlapped or the thickness of the cloth is uneven in some cases. When a stitchwork formation is performed on such a cloth, in addition to the thickness of a stitchwork pattern to be formed, the sewing machine 1 has a change in thickness of the cloth taken into consideration, and moves up and down the presser foot 8 so as to maintain the predetermined clearance with the processed cloth 100.

The actuator is not limited to the stepping motor 82, and any of conventionally well-known technologies that is capable of moving the presser bar 81 up and down is also applicable. For example, the actuator may be a linear motor that directly moves the presser bar 81 up and down.

In addition, this sewing machine 1 includes the detecting unit 92 that detects, based on the stitchwork data 93*a*, the thickness of a stitchwork pattern overlapping with the presser foot 8 in accordance with the advancement of the stitchwork formation. The detecting unit 92 is not limited to such a unit, and may be a camera that picks up the thickness of a stitchwork pattern, or a laser measurement instrument that measures the thickness of the stitchwork pattern, etc. According to the detecting unit 92 based on the stitchwork data 93*a*, however, the number of components of the sewing machine 1 is reduced, and thus a cost reduction is accomplishable.

Still further, according to this sewing machine 1, the detecting unit 92 based on the stitchwork data 93*a* includes the simulator 94. This simulator 94 simulates the arrangement of the thread for each needle locating step based on the stitchwork data 93*a*, and calculates the thread redundant number at each location for each needle locating step based on the simulated thread arrangement. Next, the detecting unit 92 detects, as the thread redundant number within the overlapping range with the presser foot 8, the thickness of a stitchwork pattern.

However, as long as the thickness of a stitchwork pattern is detectable based on the stitchwork data 93*a*, the present invention is not limited to the above structure. When, for example, the thread overlap occurs only when a color of thread changes, and the stitchwork data 93*a* is color-by-color layer data, the thickness of a stitchwork pattern is detectable upon searching the presence/absence of the lower layer color.

Yet still further, according to this sewing machine 1, the detecting unit 92 includes the table 95*a* that stores, in association with each other, the height of the presser foot 8 and the thread redundant number. Next, the stepping motor 82 changes the height of the presser foot 8 to the height associated with the thread redundant number detected by the detecting unit 92. According to this operation, the height of the presser foot 8 is determinable without a delay from the fast move-up and move-down operations of the needle 3, and thus a stitchwork productivity is excellent. Note that a precise thickness of a stitchwork pattern to be formed may be calculated based on the thread redundant number and the thread size, and the height of the presser foot 8 may be changed in accordance with a calculation result.

Other Embodiments

The embodiment of the present invention was explained above, but various omissions, replacements, and modifications can be made thereto without departing from the broadest scope of the present invention. In addition, such embodiments and modified examples thereof should be within the scope of the present invention, and also within the scope of the invention as recited in appended claims and the equivalent range thereto.

For example, the sewing machine 1 of the embodiment calculates the thread redundant number in a real-time scheme with the stitchwork formation, and determines the height of the presser foot 8 one step before. In addition to this operation, the simulation for all steps may be performed and completed before the stitchwork formation. In this case, the map 94*a* that reflects all simulated steps may be stored without an updating work to the map 94*a*. In addition, a simulation may be performed prior to several steps, and the map 94*a* by the several steps may be stored.

Alternatively, the height level may be determined in accordance with each map 94*a*, and control data that has the height level of the presser foot 8 associated with the step number may be created beforehand. The controller 91 may read, from the control data, the height level of the presser foot 8 corresponding to the next step, and may control the height of the presser foot 8.

In addition, it is appropriate as long as the photo interrupter and the elongated linear scale 87*c* move relative to each other, either one of which may be move up and down together with the presser foot 8, while the other may be stationary at a fixed position.

Still further, the amount of move-up and move-down amounts of the presser foot 8 are subjected to a feedback control by the encoder 87 as an example operation, but may be obtained by a sequence control on the stepping motor 82.

What is claimed is:

1. A sewing machine forming a stitchwork pattern on a cloth, the sewing machine comprising:

a stitchwork data memory storing stitchwork data, the stitchwork data being to form the stitchwork pattern;

a stitchwork frame fastening the cloth;

a frame driving mechanism translating the stitchwork frame horizontally along a direction of a plane where the cloth is fastened based on the stitchwork data;

a presser foot located above the cloth;

an actuator changing a height of the presser foot in accordance with an advancement of a stitchwork formation, and maintaining a predetermined clearance below the presser foot with the cloth, wherein the actuator changes the height of the presser foot in accordance with a thickness of the stitchwork pattern, the thickness of the stitchwork pattern changing in accordance with the advancement of the stitchwork formation; and a detecting unit detecting the thickness of the stitchwork pattern within a range overlapping with the presser foot in accordance with the advancement of the stitchwork formation, wherein the detecting unit calculates the thickness of the stitchwork pattern within the range overlapping with the presser foot based on the stitchwork data.

2. The sewing machine according to claim 1, wherein the detecting unit:

comprises a simulator simulating an arrangement of a thread for each needle locating step based on the stitchwork data, and calculating a thread redundant number at each location for each needle locating step based on the arrangement of the thread; and detects, as the thickness of the stitchwork pattern, the thread redundant number within the range overlapping with the presser foot.

3. The sewing machine according to claim 2, wherein:

the detecting unit further comprises a table storing, in association with each other, the height of the presser foot and the thread redundant number; and the actuator changes the height of the presser foot to the height associated with the thread redundant number detected by the detecting unit.

4. The sewing machine according to claim 1, wherein the height of the presser foot is changed in accordance with the advancement of the stitchwork formation so as to fall into a range between equal to or larger than 1.2 mm and equal to or smaller than 1.5 mm.

* * * * *